US009119233B2

(12) United States Patent
Park

(10) Patent No.: US 9,119,233 B2
(45) Date of Patent: Aug. 25, 2015

(54) TRAVEL MUG FOR MICROWAVE OVEN

(71) Applicant: Jong Peter Park, Pasadena, CA (US)

(72) Inventor: Jong Peter Park, Pasadena, CA (US)

( * ) Notice: Subject to any disclaimer, the term of this patent is extended or adjusted under 35 U.S.C. 154(b) by 62 days.

(21) Appl. No.: 13/681,071

(22) Filed: Nov. 19, 2012

(65) Prior Publication Data

US 2014/0138375 A1 May 22, 2014

Related U.S. Application Data

(63) Continuation-in-part of application No. 12/938,681, filed on Nov. 3, 2010, now Pat. No. 8,387,820.

(30) Foreign Application Priority Data

Oct. 7, 2010 (KR) ..... 10-2010-0097769

(51) Int. Cl.
*H05B 6/80* (2006.01)
*H05B 6/64* (2006.01)

(52) U.S. Cl.
CPC ..... *H05B 6/6408* (2013.01); *H05B 6/6494* (2013.01)

(58) Field of Classification Search
CPC ..... H05B 6/6494; H05B 6/6408
USPC ..... 99/279, 337, 403; 219/439, 538, 621; 220/573.1, 592.14, 592.17
See application file for complete search history.

(56) References Cited

U.S. PATENT DOCUMENTS

| | | | | |
|---|---|---|---|---|
| 2,441,131 | A | 5/1948 | Blackman et al. | |
| 2,622,591 | A | 12/1952 | Bramberry, Jr. | |
| 2,876,634 | A | 3/1959 | Zimmerman et al. | |
| 2,933,586 | A * | 4/1960 | Schusterius | 219/538 |
| 3,463,140 | A | 8/1969 | Rollor, Jr. | |
| 3,489,075 | A | 1/1970 | O'Reilly | |
| 3,547,298 | A | 12/1970 | Versluis | |
| 3,721,363 | A | 3/1973 | Bressler et al. | |
| 1,681,150 | A | 8/1978 | Vischer, Jr. | |
| 4,106,486 | A | 8/1978 | Lee | |
| 4,402,195 | A | 9/1983 | Campbell | |
| 4,629,866 | A * | 12/1986 | Proctor | 219/439 |
| 4,648,382 | A | 3/1987 | Greenbacker | |
| 4,952,765 | A | 8/1990 | Toyosawa | |
| 5,088,179 | A | 2/1992 | Gibbon | |
| 5,135,132 | A | 8/1992 | Potochnik | |
| 5,169,016 | A | 12/1992 | Hinz, Jr. | |
| 5,277,326 | A | 1/1994 | Chiba | |
| 5,508,498 | A | 4/1996 | Rheinish et al. | |
| 5,515,995 | A * | 5/1996 | Allen et al. | 220/592.16 |
| 5,918,761 | A | 7/1999 | Wissinger | |
| 5,968,618 | A * | 10/1999 | Miller | 428/34.6 |

(Continued)

FOREIGN PATENT DOCUMENTS

| | | | |
|---|---|---|---|
| CN | 201002790 | Y | 1/2008 |
| CN | 201665359 | U | 12/2010 |

(Continued)

*Primary Examiner* — Thien S Tran

(57) ABSTRACT

A travel mug that is made of metal materials and can be used for microwave oven, including a container having a double-layered structure with an inner shell and an outer shell. The inner shell and said outer shell are joined by a joint in such a way that a cavity is provided therebetween, and a heat transfer medium is filled to at least part of said cavity. A microwave-heating plate is provided between the inner and outer shells. A handle is formed on one side of said outer shell. A pressure release device is provided at one side of said outer shell.

18 Claims, 4 Drawing Sheets

(56) References Cited

U.S. PATENT DOCUMENTS

| | | | | |
|---|---|---|---|---|
| 6,191,393 | B1 | 2/2001 | Park | |
| 6,320,166 | B1 * | 11/2001 | Park | 219/439 |
| 6,386,431 | B1 | 5/2002 | Lin | |
| 6,467,645 | B2 | 10/2002 | Park | |
| 6,631,824 | B2 | 10/2003 | Park | |
| 6,672,595 | B2 | 1/2004 | Park | |
| D487,212 | S | 3/2004 | Park | |
| 6,698,337 | B1 | 3/2004 | Park | |
| 6,755,319 | B2 | 6/2004 | Park | |
| 6,802,438 | B2 | 10/2004 | Thompson | |
| 7,086,326 | B2 | 8/2006 | Yokoyama | |
| 8,393,262 | B1 | 3/2013 | Molayem | |
| 8,689,680 | B2 | 4/2014 | Park | |
| 2003/0041741 | A1 | 3/2003 | Park | |
| 2003/0102320 | A1 * | 6/2003 | Park | 220/756 |
| 2003/0209154 | A1 * | 11/2003 | Park | 99/403 |
| 2003/0209551 | A1 | 11/2003 | Park | |
| 2004/0118838 | A1 | 6/2004 | Park | |
| 2004/0232144 | A1 | 11/2004 | Edmark | |
| 2005/0098565 | A1 * | 5/2005 | Liu | 220/592.14 |
| 2005/0205577 | A1 | 9/2005 | Park | |
| 2005/0263015 | A1 | 12/2005 | Mulgrew | |
| 2006/0219712 | A1 | 10/2006 | Ramirez | |
| 2006/0289538 | A1 | 12/2006 | Hasegawa | |
| 2007/0000915 | A1 | 1/2007 | Cheng | |
| 2009/0108029 | A1 * | 4/2009 | Fromm | 222/324 |
| 2010/0199860 | A1 | 8/2010 | Seitz et al. | |
| 2012/0024845 | A1 | 2/2012 | Lee et al. | |
| 2014/0102315 | A1 | 4/2014 | Park | |
| 2014/0326733 | A1 | 11/2014 | Park | |

FOREIGN PATENT DOCUMENTS

| | | | |
|---|---|---|---|
| CN | 202229241 | U | 5/2012 |
| DE | 19544717 | A1 | 6/1997 |
| JP | 2000023828 | A | 1/2000 |
| JP | 2004241177 | A | 8/2004 |
| KR | 2003465230000 | | 4/2004 |

* cited by examiner

TRAVEL MUG FOR MICROWAVE OVEN

RELATED APPLICATION

This application is a continuation-in-part of U.S. patent application Ser. No. 12/938,681 for "Travel Mug for Microwave Oven" filed on Nov. 3, 2010.

TECHNICAL FIELD

The present invention relates to a travel mug for microwave oven, and more particularly, to a travel mug that is made of metal materials and can be used in a microwave oven.

BACKGROUND OF THE INVENTION

Typical containers used in a microwave oven are made of materials that electromagnetic waves can pass, and the materials may be, for example, glass, ceramic, resin, etc.

Materials such as metal that blocks the passing of electromagnetic waves cannot be used in a microwave oven.

However, containers made of metal are very effective for cooking food, not just for simply defrosting food.

A cooking bowl made of resin, not metal, is disclosed in Korean Patent Laid-Open No. 10-2005-0115981. This application relates to a cooking bowl for the microwave oven range, and teaches a cooking bowl with an electric wave absorber, which is formed on a lower part, in a bowl made of resin having heat resistance.

Further, as examples for cooking food in a container made of metal, US Patent Publication No. US2004/0094544 teaches a cooking vessel for heating water by the heat of the lower part of a container, which is located on the lower surface and made of a microwave permeable material, in a structure where a metal lid blocks microwaves, and US Patent Publication No. US2004/0118838 was filed and published in the name of the applicant of the present application, and teaches a vessel for cooking food by using a heating element that is made of ferrite rubber on the lower surface of the vessel made of a heat conductive material.

Meanwhile, such metal bowls have been used to cook food, but a metal travel mug has not been used yet for microwave oven because the material is made of metal such as stainless steel, and when food within the mug gets cold, the mug cannot be used to warm the food up using microwave oven.

Since the size of a mug for microwave oven is very small compared to typical cooking containers, a structure that can be used for microwave oven cannot be made with conventional techniques for cooking containers.

SUMMARY OF THE INVENTION

The present invention contrives to solve the disadvantages of the prior art.

The present invention is designed to solve the above problem, and aims to provide a travel mug for microwave oven that can be used for heating and cooking food within the mug fast and keep it warm for a long time.

An aspect of the invention provides a travel mug for microwave oven.

The travel mug for microwave oven comprises a container, inner and outer shells, and a microwave-heating plate.

The container has a double-layered structure with an inner shell and an outer shell, and said inner shell and said outer shell are joined by a joint in such a way that a cavity is provided therebetween, and a heat transfer medium is filled to at least part of said cavity.

The microwave-heating plate is disposed between the inner and outer shells for converting microwave to heat.

The travel mug may further comprise a handle formed on one side of said outer shell, a pressure release device formed at one side of said outer shell, and a lid having a receiver part forming a concave portion to receive said joint.

The microwave-heating plate may comprise a ceramic plate or a high tempered glass plate, but it is not limited to it.

The microwave-heating plate may be attached to each of the inner and outer shells by a fastening means. The fastening means may be provided by a welding.

The heat transfer medium may be, but not limited to, silicon oil.

The pressure release device may be installed inside a handle on one side of the outer shell and comprises a bracket fixedly installed with a fixing part at one side of the handle, and a valve member installed within the bracket, wherein said valve member comprises a body being hollow and cylindrical, a neck, being hollow and cylindrical, with the smallest outer diameter and with its length being the same as the thickness of the outer shell, and a head being tapered forwardly, said neck being inserted into an opening formed on the outer shell.

Each of the inner and outer shells may comprise stainless steel.

The microwave-heating material may comprise a ceramic plate, and the ceramic plate may have a thickness from about 2 mm to about 10 mm. Preferably, the ceramic plate has a thickness of about 5 mm.

According to the present invention, a travel mug for microwave oven can be easily used for microwave oven.

Also, according to the present invention, it is possible to heat and cook food within a travel mug fast, and keep the food warm for a long time.

In addition, according to the present invention, the inner pressure in an air pocket is controlled by releasing overpressure formed within the double-layered structure of the travel mug so as to prevent deformation or explosion of the body of the travel mug.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

All the contents of U.S. Pat. No. 6,320,166 issued on Nov. 20, 2001, U.S. Pat. No. 6,191,393 issued on Dec. 2, 2001, U.S. Pat. No. 6,467,645 issued Oct. 22, 2002, U.S. Pat. No. 6,631,824 issued on Oct. 14, 2003, U.S. Pat. No. 6,698,337 issued on Mar. 2, 2004, U.S. Design Pat. No. 486,352 issued on Feb. 10, 2004, U.S. Design Pat. No. 487,212 issued on Mar. 2, 2004, Korean Patent Publication No. 10-2005-0115981, US Patent Publication No. 2004/0094544, US Patent Publication No. 2004/0118838, and US Patent Publication No. 2012/0080439 are incorporated herein by reference.

Hereinafter, the present invention will be described in detail with reference to the drawings.

Figure 1:
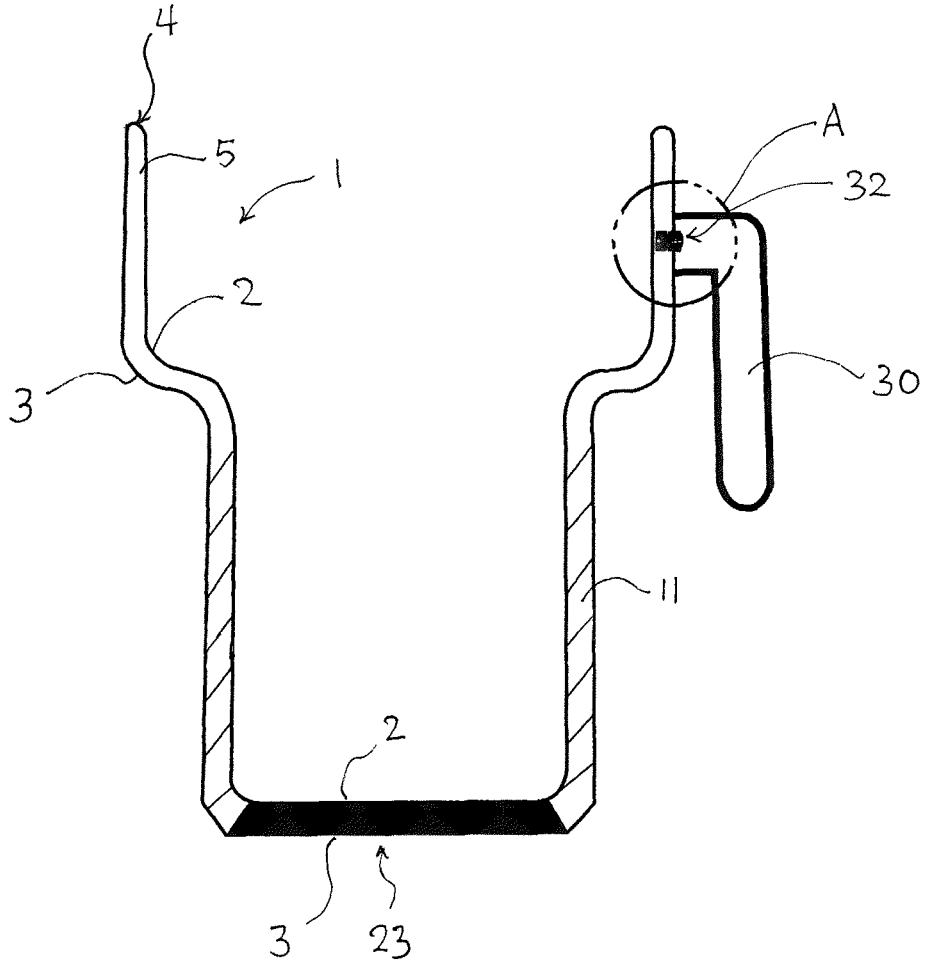
FIG. 1. shows a cross-sectional view of a travel mug for microwave oven according to the present invention.

FIG. 1. shows a cross-sectional view of a travel mug for microwave oven according to the present invention.

A container (1) of the travel mug according to the present invention has a double-layered structure with an inner shell (2), an outer shell (3), and a microwave heating plate (23), and the inner shell (2) and the outer shell (3) are joined by a joint (4) of the upper part of the container (1) of the travel mug to seal a cavity (5).

The inner shell (2) and outer shell (3) are preferably made of stainless steel, and a joint (4) may be made by electronic welding.

A heat transfer medium (11) is provided within at least part of the cavity (5) of the container (1).

The heat transfer medium (11) is preferably silicon oil.

Since silicon oil has an advantage for maintaining a melting point of −25° C. and a boiling point of 200° C., a heat preserving rate of 70%; or more can be maintained after four hours have been passed.

The microwave-heating plate (23) is disposed between the inner and outer shells (2, 3) of the container (1) for converting microwave to heat as shown in FIG. 1.

The microwave-heating plate (23) may comprise a ceramic plate or a high tempered glass plate, but it is not limited to it.

The microwave-heating plate (23) may be attached to each of the inner or outer shell (2, 3) by a fastening means. The fastening means may be provided by a welding.

The microwave-heating plate may be fixed in place just by bing inserted between the inner and outer shells by a fastening means. For example, the microwave-heating plate (23) may be disposed and held in place by the inner and outer shells (2, 3), even without any further fastening means.

Each of the inner and outer shells may comprise stainless steel.

The microwave-heating material may comprise a ceramic plate, and the ceramic plate may have a thickness from about 2 mm to about 10 mm. Preferably, the ceramic plate has a thickness of about 5 mm.

According to the present invention, a travel mug for microwave oven can be easily used for microwave oven.

When the travel mug for microwave oven according to the present invention is put in a microwave oven and heated, the microwave heating plate (23) absorbs high-frequency energy, converts it into heat energy, and transfers the heat energy to the inner or outer shell (2, 3) to heat the heat transfer medium (11) in the cavity (5) of the container (1), thereby heating the food in the travel mug for microwave oven.

A handle (30) installed on the external circumference of the container (1) of the travel mug is made of silicon materials so as to prevent the handle from being heated and slippery.

A discharge hole (32) is formed at a proper location on a side of the handle (30).

Referring to FIG. 1, the pressure release device (A), which is connected to the container (1) through a clamping hole (1*b*), includes a spring housing (6) which is affixed to the outer shell (3) of the container (1). According to one embodiment of the present invention, the spring housing (6) has a shape of a screw or bolt which is securely affixed to the outer shell (3) using a fastening nut (7). The spring housing (6) defines an elongated spring device hole (6*a*) at one end and a pressure controlling hole (6*b*) at opposite end, thus sharing the same center axis. On the outer circumference the spring housing (6) that defines the spring device hole (6*a*), there provide are threads (6*c*) for receiving a spring suspension member (10). At the other end of the spring housing (6), a screw head (6*d*) is formed to abut against the inner surface of the outer shell (3). Preferably, a washer or packing (12) may be provided between the screw head (6*d*) and the outer shell (3) to secure the sealing thereof.

Figure 2:
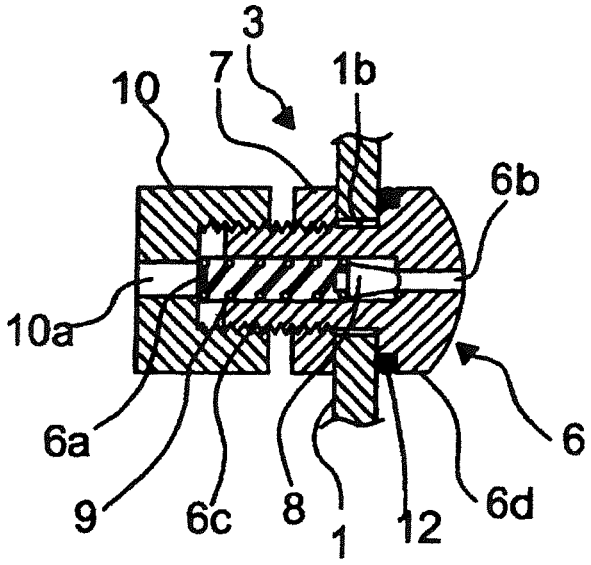
FIG. 2 shows a detailed view of a pressure release device according to the present invention.

Referring to FIG. 2, in the spring device hole (6*a*), a pressure control valve (8) made of heat-resistant rubber or other suitable material is inserted. The pressure control valve (8) preferably comprises a needle valve. A spring (9) is placed in the rear of the pressure control valve (8) and the spring suspension member (10) is coupled to the spring housing (6).

The spring (9) biases the pressure control valve 8 against the pressure controlling hole (6*b*) to substantially block the same. The spring suspension member (10) has inner threads matching that of the outer threads (6*c*) of the spring housing (6) to fastened thereto. Thus, any excess pressure generated from the cavity (5) is released through the pressure release device (A) by elastic movement of the pressure control valve (8). When sufficient pressure is created in the cavity (5), the pressure control valve (8) is pushed back by the pressure and the pressure is relieved through the pressure controlling hole (6*b*), the spring device hole (6*a*) and the orifice (10*a*) defined by the spring suspension member (10).

Hereinafter, a lid of the travel mug according to the present invention will be described.

Figure 3A:
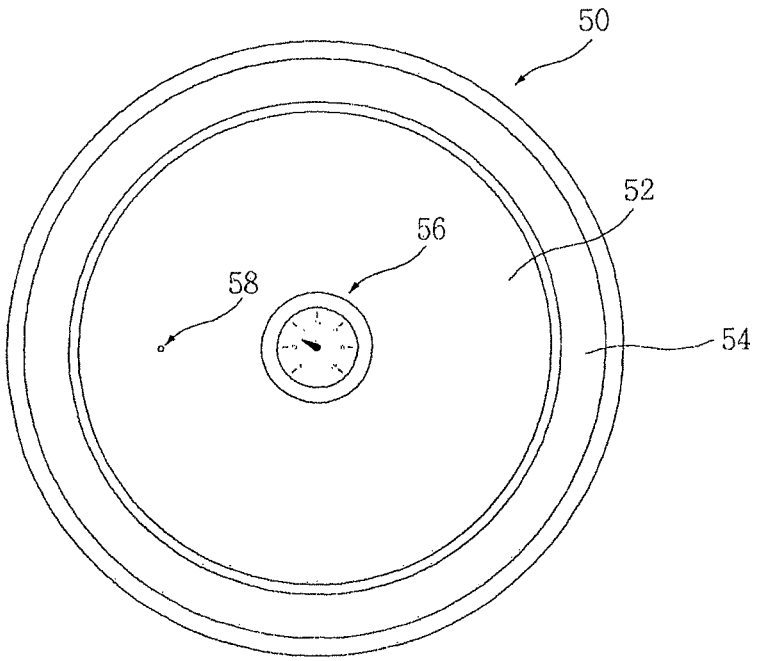
FIG. 3*a* shows a plane view of a lid of the travel mug for microwave oven according to the present invention.
Figure 3B:
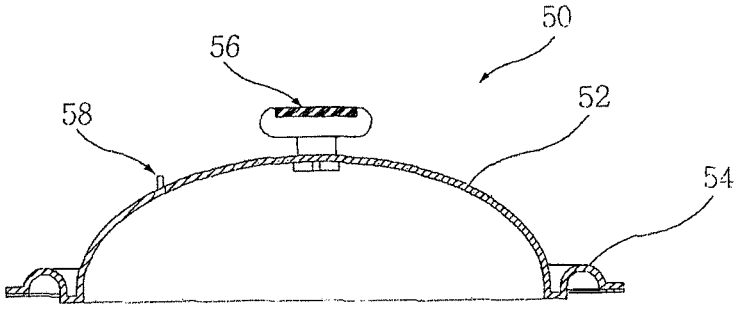
FIG. 3*b* shows a cross-sectional view of the lid of the travel mug for microwave oven according to the present invention.

FIG. 3*a* shows a plane view of a lid of the travel mug, and FIG. 3*b* shows a cross-sectional view of the lid of the travel mug.

The lid body (52) of a lid (50) of the travel mug is in a dome-shaped form, and comprises a receiver part (54) constituting a concave portion around the edge to receive a joint (4) of the travel mug.

The lid body (52) is preferably made of silicon rubber. On the upper surface of the lid body (52), a timer (56) may be installed, and a discharge hole (58) is formed on a proper location.

The travel mug for microwave oven according to the present invention is effective and economic because it enables office workers who are busy in business to cook rice porridge, soup, or rice as breakfast or lunch in an office.

In addition, since the effect of cooling is the same, the travel mug can be used for keeping food cold for a long time.

In certain embodiments of the invention, each of the inner and outer shells may comprise stainless steel.

The microwave-heating material may comprise a ceramic plate, and the ceramic plate may have a thickness from about 2 mm to about 10 mm. Preferably, the ceramic plate has a thickness of about 5 mm.

The travel mug according to the invention may be used to heat up the content in a microwave oven as well as on a stove top or induction cooker due to the microwave-heating plate sandwiched between the inner and outer shells at the bottom of the travel mug as shown in FIG. 1.

The embodiments of the present invention described above are only for examples, but the present invention is not limited to these embodiments. Various other changes and modifications can be made without departing from the spirit and scope of the invention. The present invention is not limited by the description described above, but only limited by the scope of the claims attached herewith.

What is claimed is:

1. A travel mug for a microwave oven, comprising:

a container having a double-layered structure with an inner shell and an outer shell, wherein said inner shell and said outer shell are joined by a joint in such a way that a cavity is provided therebetween, and a heat transfer medium is filled to at least part of said cavity;

a microwave-heating plate disposed between the inner and outer shells, and exposed along a bottom side of the container to absorb microwaves and convert the microwaves to heat;

a handle on a side of said outer shell;

a pressure release device on the side of said outer shell to relieve any built-up pressure within the cavity; and a lid adapted to sit on the joint to cover the container.

2. The travel mug of claim 1, wherein the microwave-heating plate comprises a high tempered glass plate.

3. The travel mug of claim 1, wherein the microwave-heating plate comprises a ceramic plate.

4. The travel mug of claim 3, wherein the microwave-heating plate is attached to each of the inner and outer shells.

5. The travel mug of claim 3, wherein the microwave-heating plate is inserted between the inner and outer shells.

6. The travel mug of claim 1, wherein said pressure release device is installed inside the handle on the side of the outer shell and opened when the cavity pressure exceeds a predetermined value, and wherein the pressure release device comprises:

a spring housing defining a spring device hole and a pressure controlling hole connected thereto, wherein the spring housing has a groove around an outer circumference thereof;

a pressure control valve in the spring device hole to block the pressure controlling hole;

a spring placed in the spring housing to bias the pressure control valve against the pressure controlling hole; and a spring suspension member having a through hole and coupled with the spring housing with a step ring being placed in the groove of the spring housing.

7. The travel mug of claim 1, wherein said heat transfer medium is silicone oil.

8. The travel mug of claim 1, wherein each of the inner and outer shells comprises stainless steel.

9. The travel mug for microwave oven of claim 1, wherein the microwave-heating material comprises a ceramic plate, wherein the ceramic plate has a thickness from about 2 mm to about 10 mm.

10. The travel mug of claim 9, wherein the ceramic plate has a thickness of about 5 mm.

11. The travel mug of claim 1, wherein the travel mug is adapted to heat up a content therein in a microwave oven.

12. The travel mug of claim 1, wherein the travel mug is adapted to heat up a content contained therein on a stove top or induction cooker.

13. The travel mug of claim 1, wherein the microwave-heating plate is disposed in between bottom portions of the inner and outer shells and exposed along a bottom side of the outer shell to absorb the microwaves and convert the microwaves to heat.

14. The travel mug of claim 1, wherein the microwave-heating plate is held in place in along the bottom side of the container by the inner and outer shells.

15. A travel mug for a microwave oven, comprising:

a container having a double-layered structure with metallic inner and outer shells, wherein said inner shell and said outer shell are joined together to form a cavity between the inner and outer shell, the cavity comprising a heat transfer medium;

an exothermic ceramic plate disposed between the inner and outer shells, and exposed along a bottom side of the container to absorb microwaves and convert the microwaves to heat;

a handle on an outer surface of the outer shell;

a pressure release device on the outer surface of the of the outer shell to relieve any built-up pressure within the cavity; and a lid adapted to cover the container.

16. The travel mug of claim 15, wherein the exothermic ceramic plate is disposed in between bottom portions of the inner and outer shells and exposed along the bottom side of the outer shell to absorb the microwaves and convert the microwaves to heat.

17. The travel mug of claim 15, wherein the exothermic ceramic plate is held in place in along the bottom side of the container by the inner and outer shells.

18. The travel mug of claim 15, wherein the heat transfer medium comprises silicone oil.

* * * * *